US006437269B1

(12) United States Patent
Rakus

(10) Patent No.: US 6,437,269 B1
(45) Date of Patent: Aug. 20, 2002

(54) SPRING POWERED ELECTRICAL SWITCHING APPARATUS WITH ANTI-ROLLOVER CAM

(75) Inventor: Paul Richard Rakus, Chippewa Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/923,902

(22) Filed: Aug. 7, 2001

(51) Int. Cl.[7] ..... H01H 5/00
(52) U.S. Cl. ..... 200/400
(58) Field of Search ..... 200/400, 401, 200/318, 321, 322–325

(56) References Cited

U.S. PATENT DOCUMENTS 4,137,437 A 1/1979 Maier et al. ..... 200/153 SC
4,439,653 A 3/1984 Umino et al. ..... 200/153 SC
5,571,255 A * 11/1996 Baginski et al. ..... 200/400
5,584,383 A * 12/1996 Matsuo et al. ..... 200/400
6,015,959 A * 1/2000 Slepian et al. ..... 200/400
6,072,136 A 6/2000 Wehrli, III et al. ..... 200/401
6,160,234 A * 12/2000 Wehril et al. ..... 200/400

* cited by examiner

*Primary Examiner*—Michael Friedhofer
(74) *Attorney, Agent, or Firm*—Martin J. Moran

(57) ABSTRACT

A spring biased anti-rollover cam extends the drop-off point on the drive cams of the spring powered operating mechanism of a power circuit breaker to preclude premature tripping in response to high short circuit currents. The anti-rollover cam retracts to facilitate normal reset of the latch mechanism when the spring of the operating mechanism is recharged for the next closing of the breaker.

12 Claims, 9 Drawing Sheets

SPRING POWERED ELECTRICAL SWITCHING APPARATUS WITH ANTI-ROLLOVER CAM

BACKGROUND OF THE INVENTION

1. Field of the Invention

This invention relates to electrical switching apparatus such as power circuit breakers, network protectors, transfer switches, and other switches used in electrical power circuits carrying large currents. More particularly, it relates to such switches having a cam assembly for applying a spring force to close the switch.

2. Background Information

Electrical switching apparatus for opening and closing electric power circuits typically utilize an energy storage device in the form of one or more large springs to close the contacts of the device into the large currents which can be drawn in such circuits. Such electrical switching apparatus includes power circuit breakers and network protectors, which provide protection, and electric switches, which are used to energize and de-energize parts of the circuit or to transfer between alternative power sources. These devices also include an opening spring or springs which rapidly separate the contacts to interrupt current flowing in the power circuit. As indicated, either or both of the closing spring and the opening spring can be a single spring or multiple springs and should be considered as either, even though the singular is hereafter used for convenience.

In a common arrangement, force stored in the close spring is transmitted to the moveable contact carrier of the switch through a drive cam and drive coupling arrangement. The drive cam is rotated by the close spring. This cam has a peripheral cam profile which varies in radius. The drive coupling includes a drive roller on a free end of a drive link connected through a bell crank to the pole shaft of the switch. A latch assembly latches the drive roller against the drive cam profile so that rotation of the drive cam by the closing spring results in rotation of the pole shaft, which being connected to the moveable contact carriers in each pole, results in closure of the switch contacts. When the latch is released, the drive roller floats allowing the open spring to rotate the movable contact carriers to open the switch contacts.

It is common to require that the switch have the capability of an immediate reclose following a trip or an intentional opening of the contacts. This makes it necessary to recharge the closing spring after it has been used to close the switch contacts. In order to allow the mechanism to reset, a reset cavity is provided in the drive cam. This results in a discontinuity in the profile of the drive cam and the formation of a tip at the end of the close section of the cam profile where the radius rapidly drops off to form the reset cavity. The latch assembly typically has a reset spring which pulls the driver roller into this cavity.

When the contacts are closed and the closing spring is recharged, the drive roller engages the drive cam profile adjacent the tip, poised for a rapid reset when the latch is released. This arrangement has worked very well in many models of power switches. Recently, there have been efforts to increase the ratings of these power switches. The withstand currents at these higher ratings, which are the short circuit currents that the switch such as a circuit breaker must tolerate to provide time for downstream circuit breakers to respond, develop forces that cause elastic deflection in the drive coupling. This leads to the drive roller creeping off of the close section of the cam profile and dropping into the reset cavity. The resulting premature trip has adverse consequences. The coordination between switches in a distribution system is upset. The tip of the drive cam is deformed, leading to an even earlier trip the next time. Also, this early trip can apply a damaging force to the close prop which latches the charged close spring. If the point of drop off of the cam profile is moved further around the drive cam, the tip at the drop off becomes vulnerable to damage, and/or the reset cavity is obstructed and the mechanism will not reset properly.

There is a need, therefore, for an improved electrical switching apparatus for power circuits which is not susceptible to premature trips.

SUMMARY OF THE INVENTION

This need and others are satisfied by the invention which is directed to electrical switching apparatus having an anti-rollover cam extendable beyond the tip of the close section on the drive cam cam profile to prevent a premature trip. This anti-rollover cam retracts to allow the drive roller to freely enter the reset cavity when unlatched by the latch mechanism.

More particularly, the invention is directed to electrical switching apparatus comprising at least one pole having separable contacts comprising fixed contacts and movable contacts and a carrier mounting the movable contacts for movement to open and close the separable contacts. An operating mechanism, which moves the contact carrier of each pole between the open and closed positions, comprises a closing spring assembly and a cam assembly coupled to and rotated by the close spring assembly. The cam assembly includes a drive cam mounted on the cam shaft and having a cam profile including a close section with a tip from which the cam profile falls off to form a reset cavity. The apparatus further includes a drive coupling connected to the carriers and a latch assembly selectively latching the drive coupling into engagement with the close section of the drive cam cam profile to drive the carriers to the closed position as the drive cam is rotated by the close spring assembly, and to unlatch the drive coupling allowing the drive coupling to drop into the reset cavity and move the carriers to the open position. The cam assembly includes an anti-rollover cam movable relative to the drive cam to an extended position extending the close section of the drive cam profile circumferentially beyond the tip to prevent rollover of the drive coupling into the reset cavity with the drive coupling latched, but retracting with the drive coupling unlatched and dropped into the reset cavity.

Preferably, the anti-rollover cam is pivotally mounted on the cam shaft and is biased by a bias spring to the extended position. In a particularly advantageous arrangement, the drive cam is formed by a pair of cam plates spaced apart on the cam shaft and the anti-rollover cam is mounted on the cam shaft between the pair of drive cam plates. Also preferably, the anti-rollover cam extends radially beyond the tip on the drive cam so that the forces are taken by the anti-rollover cam and the tip does not become deformed.

In another preferred arrangement, the drive coupling includes a drive roller which engages the drive cam cam profile and the latch assembly includes a reset spring which pulls the drive roller into the reset cavity. The reset spring is sufficiently stronger than the bias spring such that the anti-rollover cam is retracted by the reset spring pulling the drive roller into the reset cavity. The anti-rollover cam can have a transition surface, which is preferably arcuate between a radial facing surface and a circumferentially facing surface. This transition surface is configured to generate a circumferential component of force initiating retraction of the anti-rollover cam as the latch mechanism unlatches the drive coupling and the reset spring pulls the drive roller toward the reset cavity.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a power air circuit breaker; however it also has application to other types of electrical switching apparatus for opening and closing electric power circuits, including electrical switching apparatus which utilizes vacuum interrupters. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention can also be applied to network protectors which provide protection and isolation for distribution circuits in a specified area.

Figure 1:
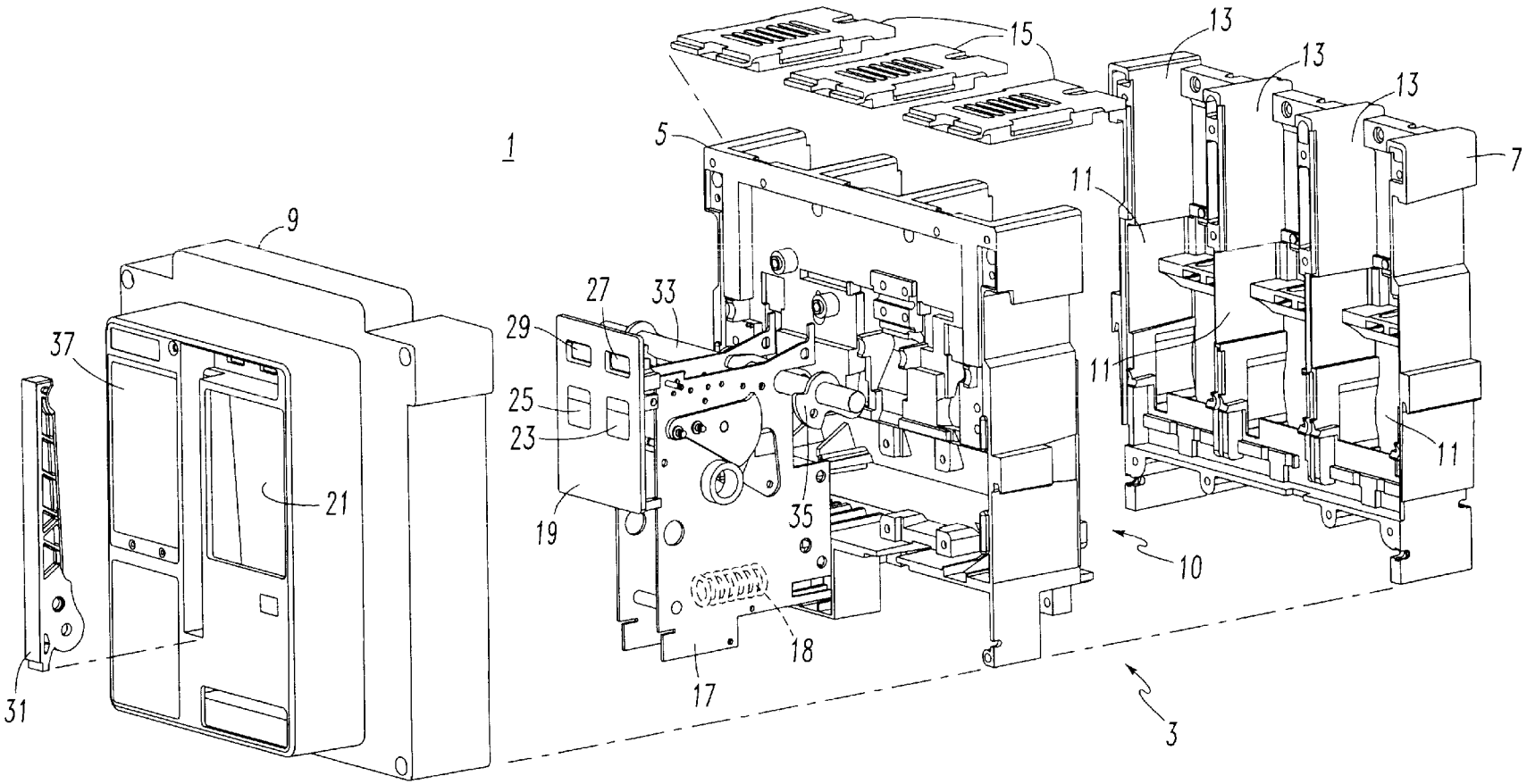
FIG. 1 is an exploded isometric view of a high current power circuit breaker incorporating the invention.

Referring to FIG. 1, the power air circuit breaker 1 of the invention has a housing 3 which includes a molded front casing 5, a rear casing 7, and a cover 9. The exemplary circuit breaker 1 has three poles 10 with the front and rear casings 5,7 forming three pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large spring 18 which is charged to store energy for closing the circuit breaker. Face plate 19 mounts a push to close button 23 which is actuated to discharge the close spring 18 for closing the circuit breaker, and a push to open button 25 for opening the circuit breaker. Indicators 27 and 29 display the condition of the close spring and the open/closed state of the contacts, respectively. The closing spring 18 is charged by operation of the charging handle 31 or remotely by a motor operator (not shown).

The common operating mechanism 17 is connected to the individual poles by a pole shaft 33 with a lobe 35 for each pole 10. As is conventional, the circuit breaker 1 includes an electronic trip unit 37 which actuates the operating mechanism to open all of the poles 10 of the circuit breaker through rotation of the pole shaft 33 in response to predetermined characteristics of the current flowing through the circuit breaker.

Figure 2:
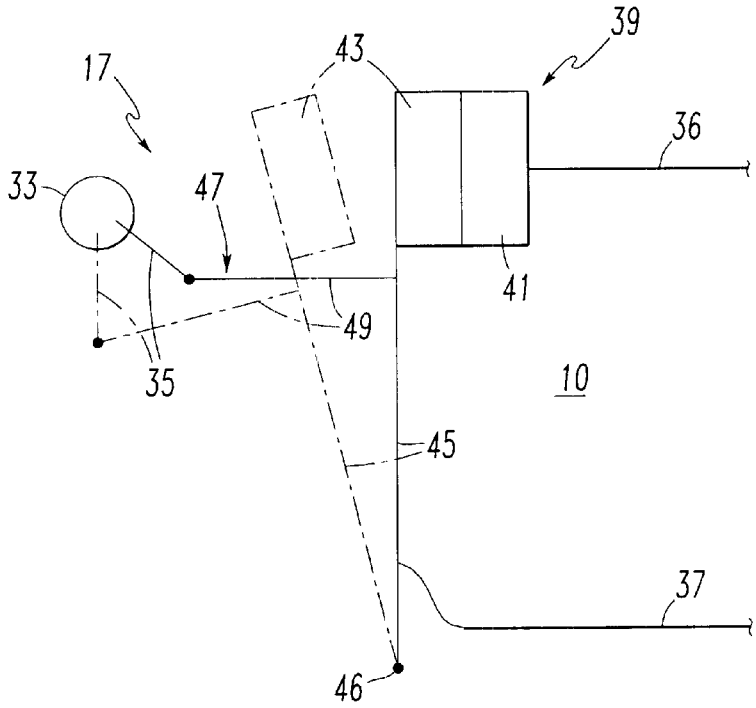
FIG. 2 is a stick diagram of a pole of the circuit breaker shown in full line with the contacts closed and in phantom line with the contacts open.
Figure 3:
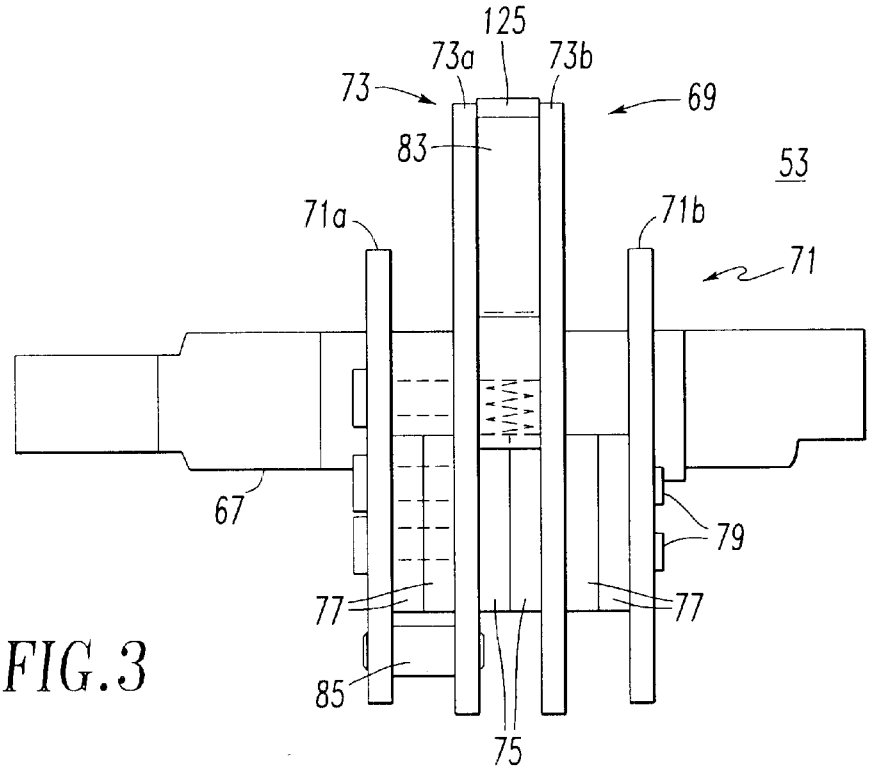
FIG. 3 is a front elevation view of the cam assembly which forms part of the operating mechanism of the circuit breaker.

FIG. 2 is a schematic representation of one of the poles 10 of the circuit breaker 1. Each pole 10 includes a line side conductor 36 for connection to a source of ac electric power (not shown) and a load conductor 37 for connection to the conductors of a load network (also not shown). A pair of separable contacts 39 include a fixed contact 41 connected to the line side conductor 36 and a movable contact 43 carried by a moving contact carrier 45 and electrically connected to the load side conductor 37. The contact carrier 45 is pivotally mounted at 46 for movement between a closed position shown in full line in FIG. 2 in which the separable contacts 39 are closed, and an open position shown in phantom line in which the separable contacts are open. Typically, the fixed contact 41 and the movable contact 43 in each pole comprise a plurality of contacts. An example of a suitable pole mechanism is illustrated in U.S. Pat. No. 6,005,206.

The contact carrier 45 is rotated between the open and closed positions to open and close the separable contacts 39 by the operating mechanism 17, which includes a drive coupling 47. The drive coupling 47 includes a drive linkage 49 connected at one end to the carrier 45 and at the other end to a lobe 35 on the pole shaft 33. The contact carrier 45 of each of the poles 10 is connected to the pole shaft in this manner.

Turning to FIG. 3–7, the operating mechanism 17 also includes a spring assembly 51 and a cam assembly 53. The spring assembly 51 includes the helical compression spring 18, which is mounted at one end for rotation about a fixed support pin 55 which is supported between a side plates 57 (only one shown). The side plates 57 form part of a cage of the modular operating mechanism 17, which is described in detail in U.S. Pat. No. 6,072,136. The other end of the spring 18 is coupled to a rocker arm 59 by a U-shaped bracket 61 through coupling pins 63. The rocker 59 is pivotally mounted on a rocker shaft 65 also supported by the side plates 57. A pair of rocker rollers 66 rotatably mounted on the other end of the rocker 59 engage the cam assembly 53, which will now be described.

Figure 8:
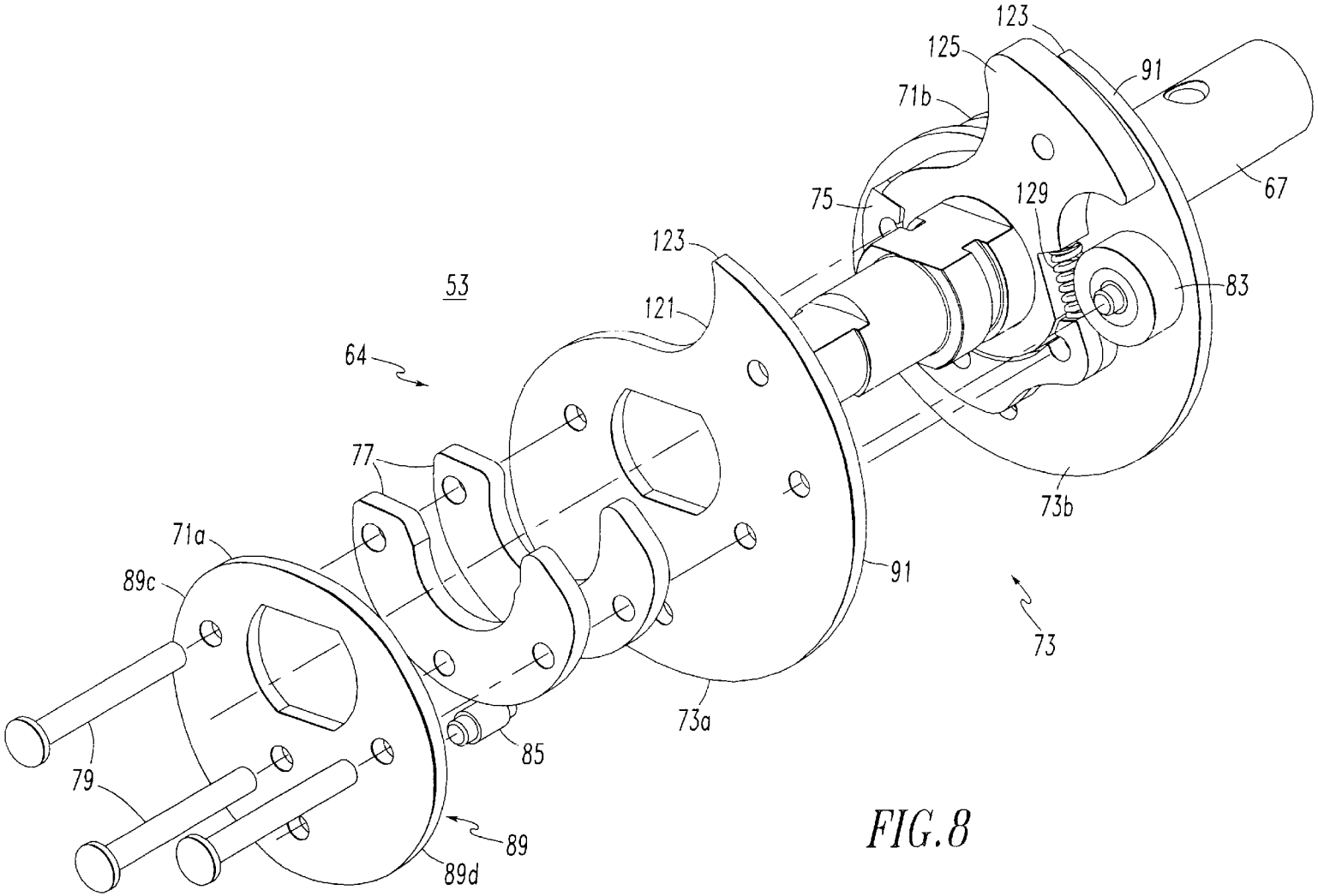
FIG. 8 is an exploded isometric view of the cam assembly.
Figure 9:
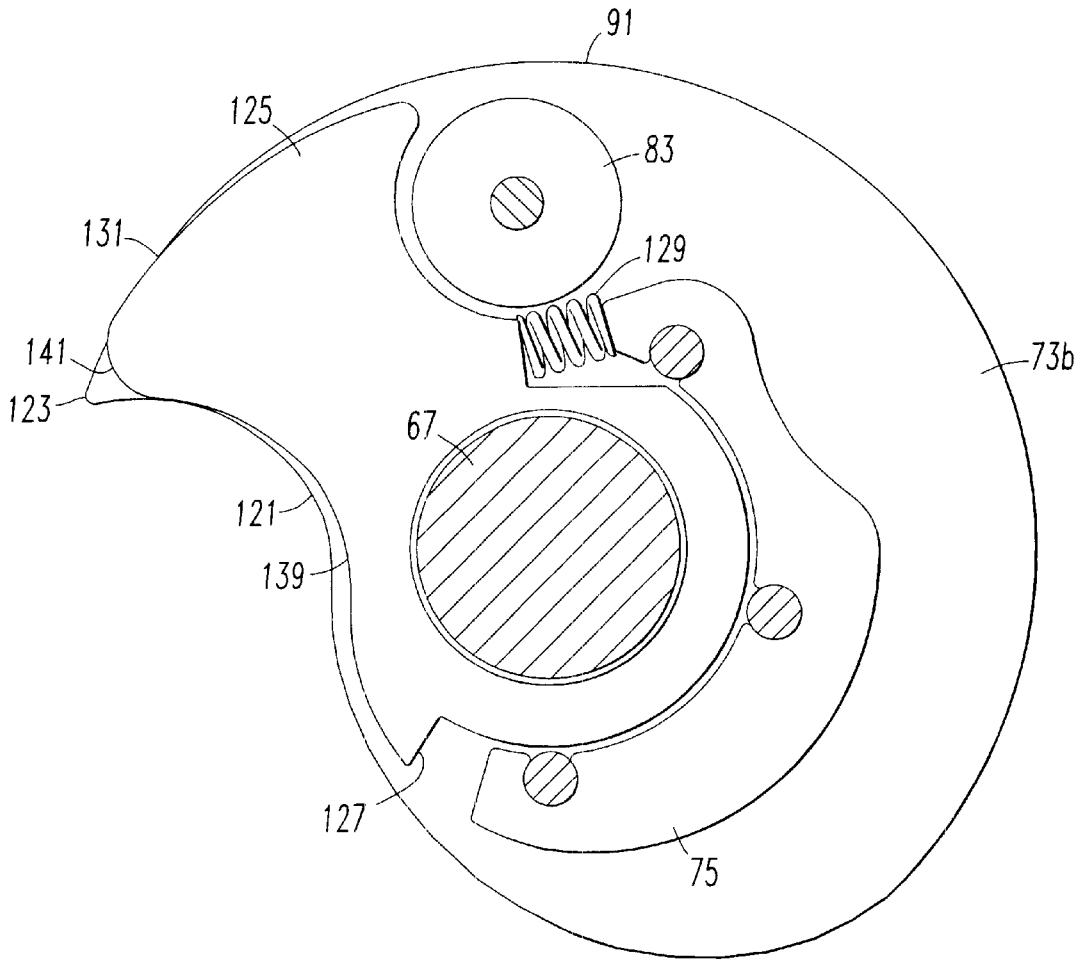
FIG. 9 is a cross-sectional view through the cam assembly showing the mounting of the anti-rollover cam.
Figure 10:
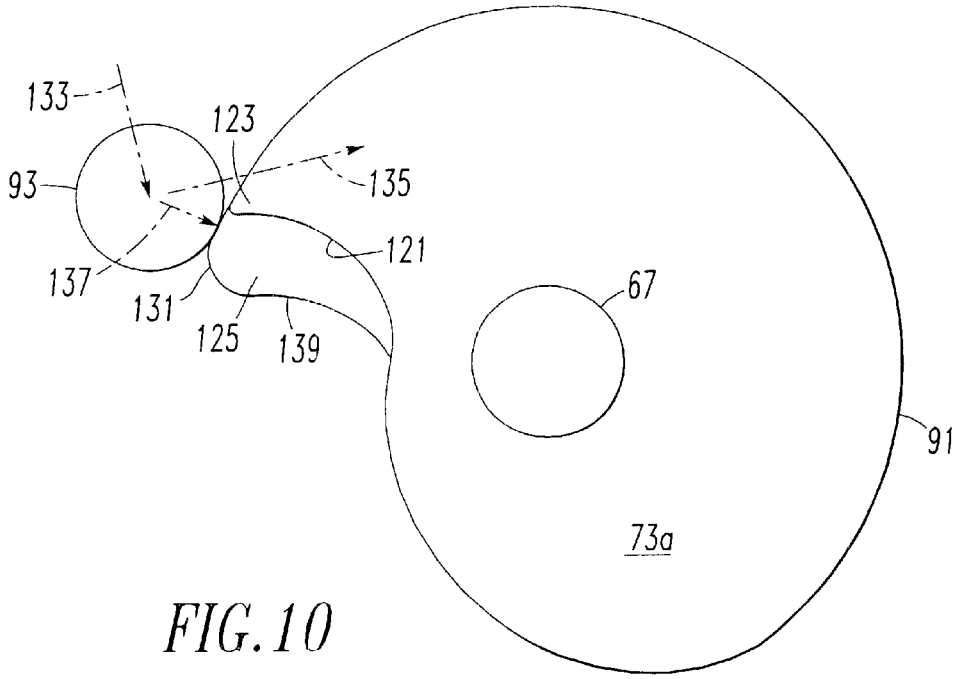
FIG. 10 is an elevation view showing the anti-rollover cam in the extended position and engaged by the drive roller.
Figure 11:
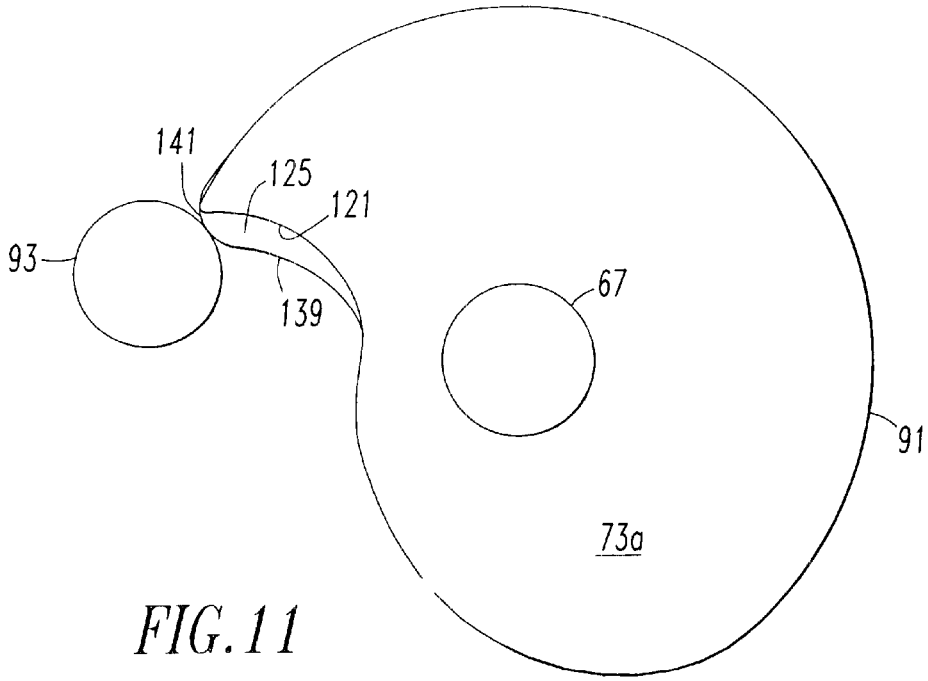
FIG. 11 is a view similar to FIG. 10 showing the anti-rollover cam partially retracted.

The cam assembly 53 includes a cam shaft 67 supported at its ends in the side plates 57 and a cam member 69. The cam member 69 includes a charge cam 71 formed by a pair of charge cam plates 71*a,* 71*b* mounted on the cam shaft 67 (see particularly FIG. 3). These charge cam plates 71*a,* 71*b* straddle a drive cam 73, which is formed by a second pair of cam plates 73*a,* 73*b*. Referring also to FIGS. 8 and 9, a cam spacer 75 sets the spacing between the drive cam plates 73*a,* 73*b* while spacer bushings 77 separate the charge cam plates 71*a,* 71*b* from the drive cam plates. The cam plates 71,73 are all secured together by rivets 79 extending through the spacer bushings 77, the drive plates 71,73 and the cam spacer 75. A stop roller 83 is pivotally mounted between the drive cam plates 73*a*, 73*b* and a reset pin 85 extends between the charge cam plate 71*a* and the drive plate 73*a*.

The cam assembly 53 is a 360° mechanism which compresses the spring 18 to store energy during part of the rotation, and which is rotated by release of the energy stored in the spring 18 during the remainder of rotation. This is accomplished through engagement of the charge cam plates 71*a*, 71*b* by the rocker rollers 66. A preload on the spring 18 maintains the rocker rollers 66 in engagement with the cam plates 71*a*, 71*b* . The charge cam 71 has a cam profile 89 with a charging portion 89*c*, which at the point of engagement with the rocker rollers 66 increases in diameter with clockwise rotation of the cam member 69. The cam shaft 67, and therefore the cam member 69, is rotated either manually by the handle 31 or by an electric motor (not shown). The charging portion 89*c* of the charge cam profile 89 is configured so that a substantially constant torque is required to compress the spring 18.

The cam profile 89 on the charge cam 71 also includes a closing portion 89*d* which decreases in diameter as the charge cam 71 rotates against the rocker rollers 66 so that the energy stored in the spring 18 drives the cam member 69 clockwise when the mechanism is released.

The drive cam 73 of the cam member 69 also has a cam profile 91, which in certain rotational positions is engaged by a drive roller 93 mounted on a main link 95 of the drive coupling 47 by a roller pin 97. The other end of the main link 95 is pivotally connected to a drive arm 99 on the pole shaft 33 by a pin 101.

Figure 6:
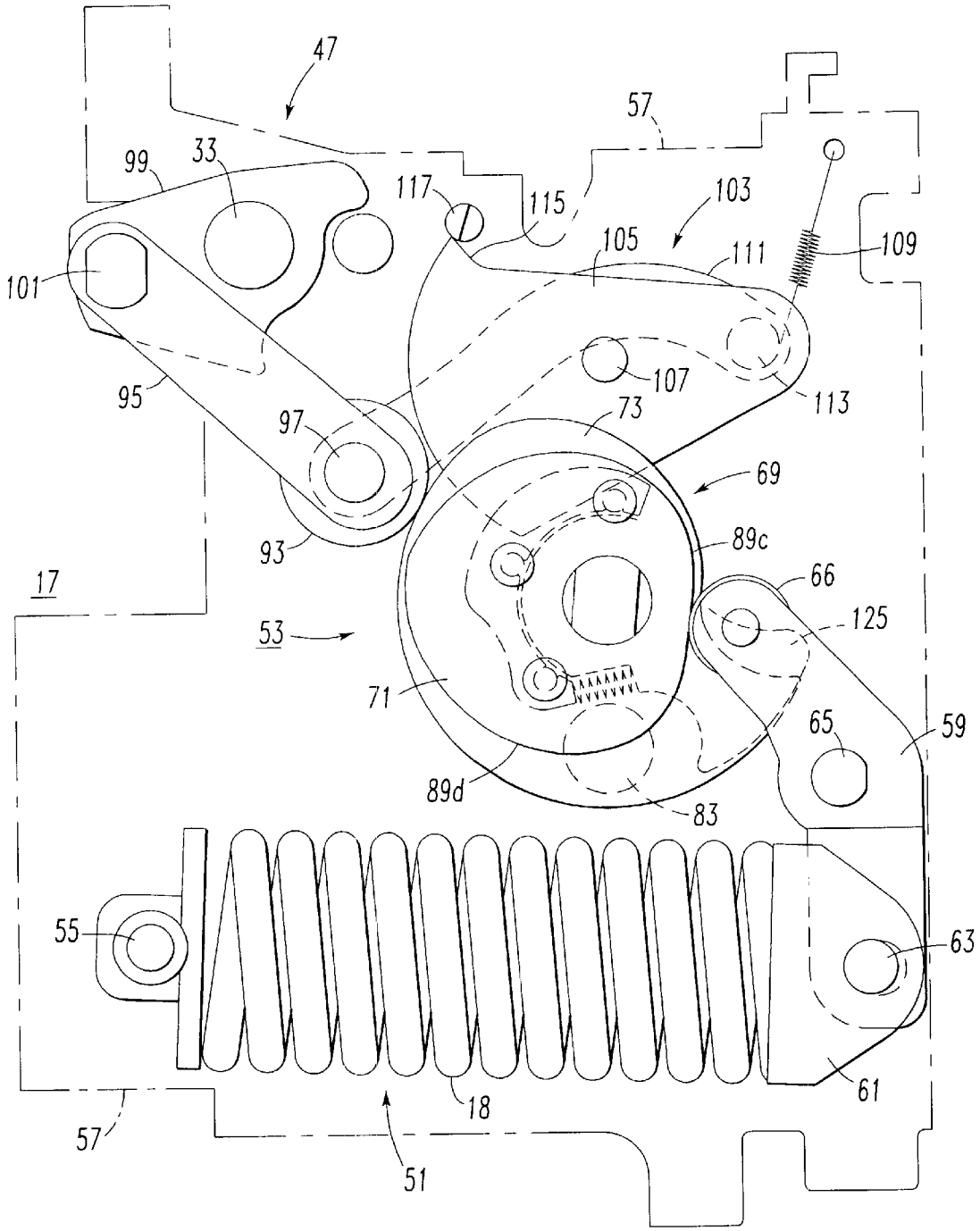
FIG. 6 is a view similar to FIG. 4 shown with the contacts closed and the close spring discharged.
Figure 7:
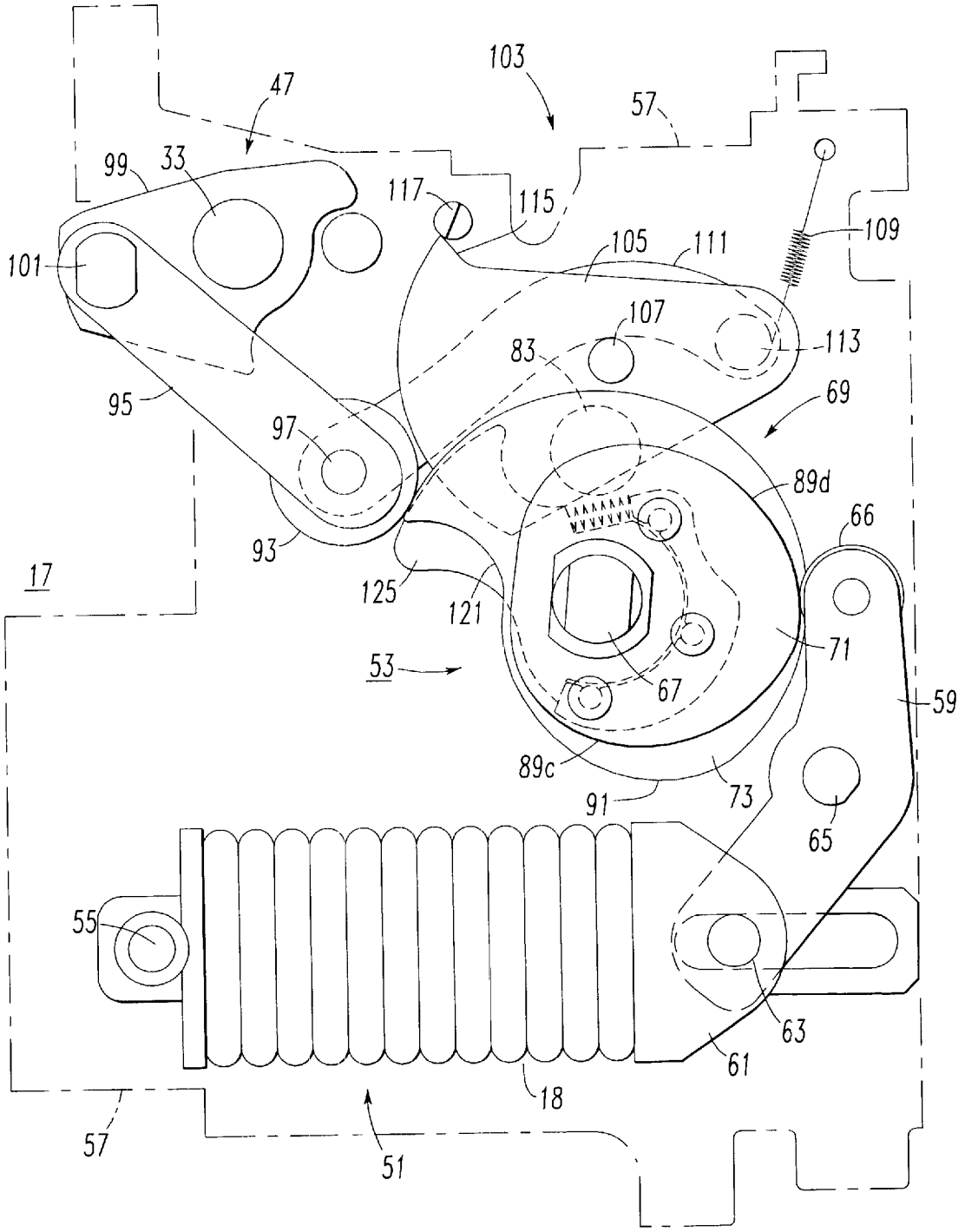
FIG. 7 is a view similar to FIG. 4 shown with the contacts closed and the close spring charged.

The drive coupling 47 is coupled to the drive cam 73 for closing the circuit breaker 1 by a latch mechanism 103 which also forms part of the operating mechanism 17. The latch mechanism 103 includes a hatchet plate 105 pivotally mounted on a hatchet pin 107 supported by the side plates 57 and biased counterclockwise in FIGS. 4–7 by a reset spring 109. A banana link 111 is pivotally connected at one end to an extension on the roller pin 97 and at the other end is pivotally connected to one end of the hatchet plate 105 by a pin 113. The other end of the hatchet plate 105 has a latch ledge 115 which engages a trip D shaft 117 when the shaft is rotated to a latched position. With the hatchet plate 105 latched, the banana link 111 holds the drive roller 93 in engagement with the cam plates of the drive cam 73, as shown in FIGS. 6 and 7. In operation, when the trip D shaft 117 is rotated to a trip position, the latch ledge 115 slides off the trip D shaft 117 and the hatchet plate 105 passes through a notch 119 in the trip D shaft which repositions the pivot point of the banana link 111 connected to the hatchet plate 105 and allows the drive roller 93 to float independently of the drive cam 73 as shown in FIG. 4, for instance.

Figure 4:
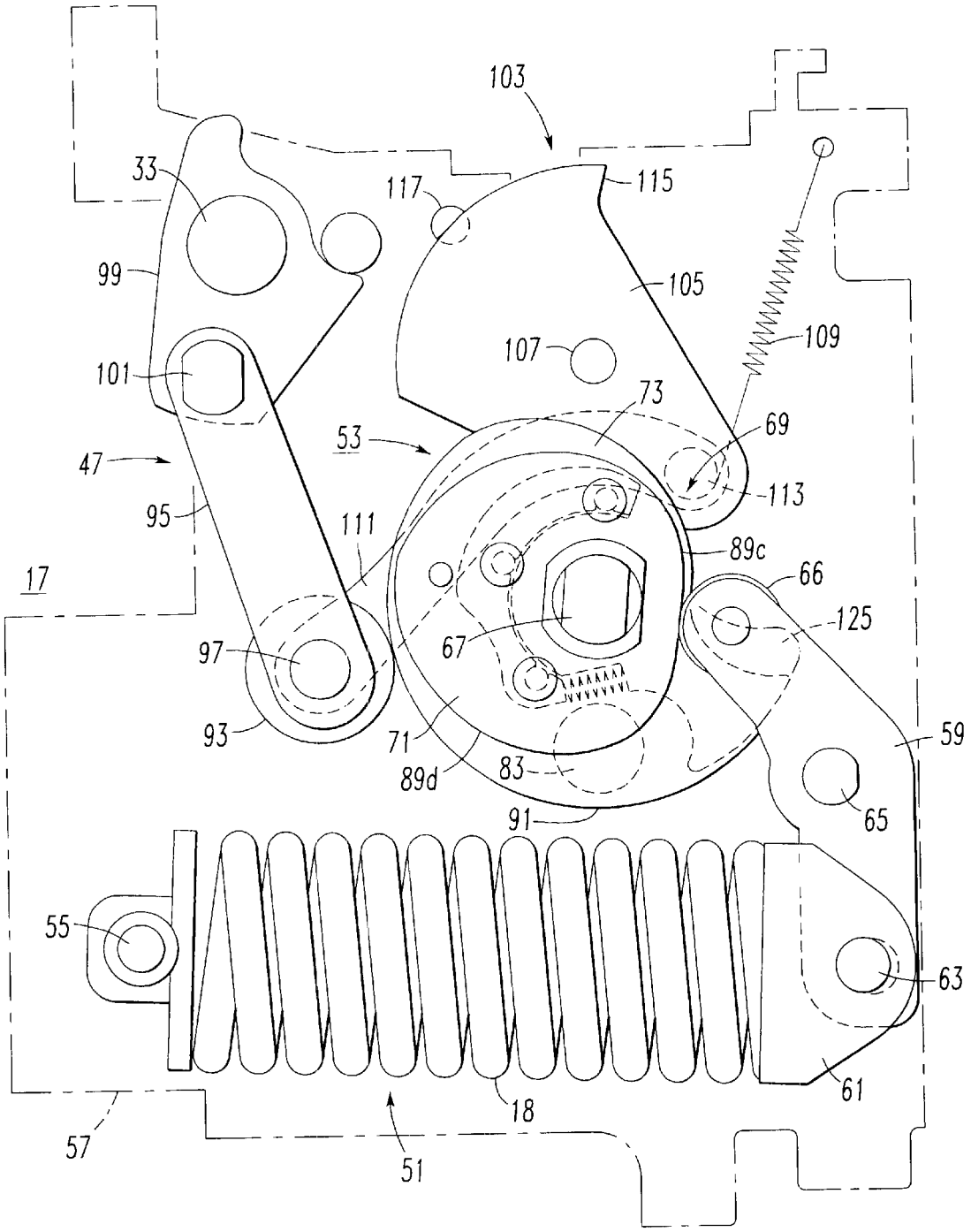
FIG. 4 is a side elevation view illustrating the relationship of the major components of the operating mechanism of the circuit breaker shown with the contacts open and the close spring discharged.

The sequence of charging and discharging the close spring 18 and the opening and closing of the separable contacts can be understood by reference to FIGS. 4–7. In FIG. 4, the operating mechanism 17 is shown in the discharged open position, that is, the close spring 18 is discharged and the separable contacts 39 are open. It can be seen that the cam member 69 is positioned so that the charge cam 71 has its smallest radius in contact with the rocker rollers 66. Thus, the rocker 59 is rotated to a full counterclockwise position and the spring 18 is at its maximum extension. It can further be seen that the latch mechanism 103 is not latched so that the drive roller 93 is floating, although resting against the drive cam 73. As the cam shaft 67 is rotated clockwise, manually by the handle 31 or through operation of a charge motor, the charge portion 89*c* of the charge profile 89 on the charge cam 71, which progressively increases in diameter, engages the rocker rollers 66 and rotates the rocker 59 clockwise to compress the spring 18. As mentioned, the configuration of this charge portion 89*c* of the profile is selected so that a constant torque is required to compress the spring 18. During this charging of the spring 18, the drive roller 93 is biased against a portion of the drive cam profile 91 which has a constant radius by the reset spring 109, but since the latch mechanism 103 is not latched, the drive roller 93 continues to float.

Figure 5:
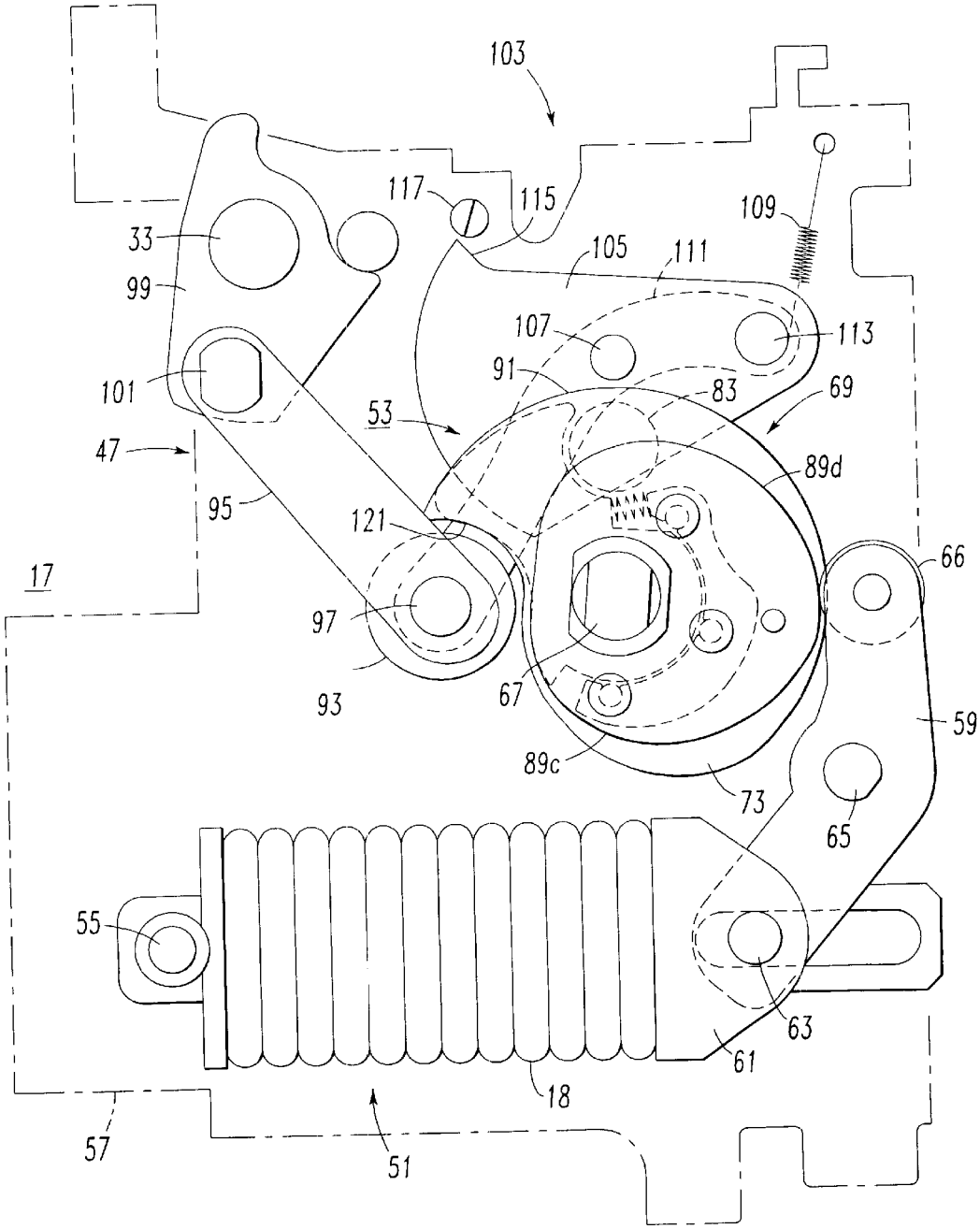
FIG. 5 is a view similar to FIG. 4 shown with the contacts open and the close spring charged.

Moving now to FIG. 5, as the spring 18 becomes fully charged, the drive roller 93 falls off of the drive cam profile 91 of the drive cam 73 into a reset cavity 121. This permits the reset spring 109 to rotate the hatchet plate 105 counterclockwise until the latch ledge 115 passes slightly beyond the trip D shaft 117. This in turn raises the pivot point 113 of the banana link 111 on the hatchet plate 105 so that the drive roller 93 is raised to a position where it rests beneath the reset cavity 121 in the drive cam 73. At the same time, the rocker rollers 66 reach a point just after 170° of rotation of the cam member 69 where they enter the close portion 89*d* of the charge cam profile 89. On this portion 89*d* of the charge cam profile, the radius of the charge cam 71 in contact with the rocker rollers 66 decreases with clockwise rotation of the cam member 69. Thus, the close spring 18 applies a force tending to continue rotation of the cam member 69 in the clockwise direction. However, a close prop (not shown) engages the stop roller 83 and prevents further rotation of the cam member 69 in a known manner. Thus, the spring 18 remains fully charged ready to close the separable contacts 39 of the circuit breaker 1.

The separable contacts 39 of the circuit breaker 1 are closed by release of the stop roller 83. With the stop roller 83 released, the energy stored in the spring 18 is released to rapidly rotate the cam member 69 to the position shown in FIG. 6. As the cam member 69 rotates, the drive roller 93 is engaged by the cam profile 91 of the drive cam 73. The radius of this cam profile at the point against which the banana link 111 holds the drive roller 93 increases with cam shaft rotation so that the pole shaft 33 is rotated to close the separable contacts 39 as described in connection with FIG. 2. At this point, the latch ledge 115 engages the trip D latch 117 and the contacts are latched closed. If the circuit breaker 1 is tripped at this point by rotation of the trip D shaft 117 so that the latch ledge 115 is disengaged from the trip D shaft 117, the very large force generated by contact springs within the pole mechanism of FIG. 2 (not shown) exerted through the main link 95 pulls the pivot point 113 of the banana link 111 on the hatchet plate 105 clockwise downward and the drive roller 93 drops free of the drive cam 73 allowing the pole shaft 33 to rotate the separable contacts 39 to open. With the contacts 39 open and the spring 18 discharged, the mechanism would again be in the state shown in FIG. 4.

Typically, when the circuit breaker is closed, the close spring is recharged, again by rotation of the cam shaft 67, either manually or electrically. This causes the cam member 69 to return to the same position as in FIG. 5, but with the latch mechanism 103 latched, the banana link 111 keeps the drive roller 93 engaged with the drive profile 91 on the drive cam 73 as shown in FIG. 7. If the circuit breaker is tripped at this point by rotation of the trip D latch 117, so that the hatchet plate 105 rotates clockwise, the drive roller 93 will drop into the reset cavity in the drive cam 73 and the circuit breaker will open.

As can be seen from FIGS. 6 and 7, when the separable contacts 39 are closed, the drive roller 93 is constrained by the latched latch mechanism 103 to remain in contact with the large radius section on the drive cam profile 91. With the close spring 18 recharged after closing, as shown in FIG. 7, the drive cam 73 is positioned so that the drive roller is adjacent the end of the close section of the drive cam profile where it drops off abruptly to form the reset cavity 121. When the breaker is tripped, the constraint applied by the latch mechanism 103 to the drive coupling 47 is removed and the drive roller 93 is free to ride down the drive cam plates 73*a,* 73*b,* allowing the breaker pole shaft 33 to rotate and open the separable contacts 39. With the spring 18 charged, the drive roller 93 is then pulled by the reset spring 109 into the reset cavity 121 allowing the latch mechanism 103 to reset for closing, as described above.

The power circuit breaker 1 is often used in a distribution system where it must withstand short circuit currents for a time sufficient for downstream breakers to respond to the fault. In adapting the circuit breaker to higher current ratings, the very high short circuit currents have been found to cause the constraint on the drive roller 93 provided by the latch mechanism 103 and the drive coupling 47 to allow the roller to deflect slightly. This undesirable elastic deflection allows the drive roller 93 to creep down the drive cam profile 91 to the point of the abrupt drop-off. If the point of contact between the drive roller 93 and the drive cams 73*a,* 73*b* reaches the beginning of this drop-off, aggravating forces quickly escalate, the drive roller 93 drops off the drop-off into the reset cavity 121, and the breaker trips prematurely. It will be noticed that as the reset cavity is concave to accommodate the drive roller 93 that a tip 123 is formed on the drive cams 73*a,* 73*b* at the point of the abrupt drop off. The very high forces applied to the drive cams during a premature trip can distort this tip 123, thereby leading to an even earlier premature trip in response to a subsequent fault. If the cam profile 91 on the drive cams 73*a,* 73*b* is extended counterclockwise as viewed in FIG. 7 to prevent a premature trip, damage can occur to the tip 123, and/or the reset cavity 121 can be obstructed and the latch mechanism 103 will not reset properly.

To overcome these difficulties, the invention provides an anti-rollover cam 125, which as shown in FIGS. 8–11 is pivotally mounted on the cam shaft 67 between the drive cam plates 73*a,* 73*b.* This anti-rollover cam 125 is free to rotate on the cam shaft 67 over a limited range relative to the drive cam plates 73*a,* 73*b* and is lightly spring biased to an extended position against a stop formed by the shoulder 127 which engages the cam spacer 75 by a bias spring 129. In the extended position shown in FIG. 10, the anti-rollover cam profile 131 effectively extends the large radius of the drive cam plates 73*a,* 73*b* beyond the tip 123 and, hence, the previous drop-off point. This is shown schematically in FIG. 10 where is can be seen that the short circuit force represented by the arrow 133 and the constraint force 135 applied by the latch mechanism apply a resultant force having a component represented by the arrow 137 on the anti-rollover cam 125 which is radial. The rollover cam profile 131 can extend radially outward slightly beyond the large radius of the drive cam plates 73*a,* 73*b* to remove the loading from the tips 123. The trailing edge 139 of the anti-rollover cam 125 is concave so that in a retracted position shown in FIG. 9, it does not obstruct the reset cavity 121. A transition section 141 between the generally radially facing rollover cam profile 131 and the generally circumferentially facing trailing edge 139 is arcuate with a decreasing radius so that when the breaker trips and the drive roller 93 is allowed to move downward, it bears against the transition section 141 to generate a component of force which retracts the rollover cam 125 between the drive cam plates 73*a,* 73*b.* The bias spring 129 is weaker than the reset spring 109 on the latch mechanism 103 so that the drive roller 93 can be pulled fully into the reset cavity 121 to allow resetting of the latch mechanism as previously described. Thus, the anti-rollover cam 125 is retained in the retracted position by the reset spring 109 until the circuit breaker 1 is again closed.

The solution provided by the invention is modular and simple to manufacture, and is therefore cost effective. The mechanism enhancement is contained in a special cam shaft assembly that can be specified only when required for the highest short circuit ratings in the circuit breaker range.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. Electrical switching apparatus comprising:

at least one pole having separable contacts comprising fixed contacts and moveable contacts and a carrier mounting the moveable contacts for movement to open and close the separable contacts; and an operating mechanism for moving the carrier of each pole between open and closed positions to open and close the separable contacts, the operating mechanism comprising:

a spring assembly;

a cam assembly coupled to and rotated by the spring assembly and comprising a cam shaft and a drive cam mounted on the cam shaft, the drive cam having a cam profile with a tip from which the cam profile falls off to form a reset cavity;

a drive coupling connected to the carrier; and a latch mechanism selectively latching the drive coupling into engagement with the drive cam profile to drive the carrier to the closed position as the drive cam is rotated by the spring assembly, and to unlatch the drive coupling allowing the drive coupling to drop into the reset cavity and move the carrier to the open position, the cam assembly including an anti-rollover cam moveable relative to the drive cam to an extended position extending the drive cam profile circumferentially beyond the tip to prevent rollover of the drive coupling into the reset cavity with the drive coupling latched, but retracting with the drive coupling unlatched and dropped into the reset cavity.

2. The electrical switching apparatus of claim 1 wherein the drive cam comprises a pair of drive cam plates mounted in spaced relation on the cam shaft with the anti-rollover cam rotatably mounted on the cam shaft between the pair of drive cam plates.

3. The electrical switching apparatus of claim 1 wherein the anti-rollover cam extends radially outward farther than the tip on the drive cam profile.

4. The electrical apparatus of claim 1 wherein the anti-rollover cam is pivotally mounted for rotation on the cam shaft.

5. The electrical switching apparatus of claim 4 wherein the cam assembly includes a bias spring biasing the anti-rollover cam to the extended position.

6. The electrical switching apparatus of claim 5 wherein the drive cam comprises a pair of drive cam plates mounted in spaced relation on the cam shaft with the anti-rollover cam rotatably mounted on the cam shaft between the pair of drive cam plates.

7. The electric switching apparatus of claim 6 wherein the anti-rollover cam extends radially outward beyond the drive cam plates.

8. The electrical switching apparatus of claim 6 wherein the cam assembly further comprises a stop setting the extended position of the anti-rollover cam.

9. The electrical switching apparatus of claim 5 wherein the cam assembly further comprises a stop setting the extended position of the anti-rollover cam.

10. The electrical switching apparatus of claim 5 wherein the drive coupling includes a drive roller engaging the drive cam profile with the latch mechanism latched and wherein the latch mechanism includes a reset spring which pulls the drive roller into the reset cavity, the reset spring being sufficiently stronger than the bias spring such that the anti-rollover cam is retracted by the reset spring pulling the drive roller into the reset cavity.

11. The electrical switching apparatus of claim 10 wherein the bias spring biases the anti-rollover cam circumferentially to the extended position, and the anti-rollover cam has a generally radially facing surface, a generally circumferentially facing surface and a transition surface between the generally radially facing surface and the generally circumferentially facing surface, the transition surface being configured to generate a circumferential component of force initiating retraction of the anti-rollover cam as the latch mechanism unlatches the drive coupling and the reset spring pulls the drive roller toward the reset cavity.

12. The electrical switching apparatus of claim 11 wherein the transition surface is arcuate.

* * * * *